US011511547B2

(12) United States Patent
Shimamura

(10) Patent No.: US 11,511,547 B2
(45) Date of Patent: Nov. 29, 2022

(54) INK CARTRIDGE HAVING A SWING BODY ADAPTED TO PIVOTALLY MOVE SMOOTHLY EVEN IF INK IS CONSUMED

(71) Applicant: CANON KABUSHIKI KAISHA, Tokyo (JP)

(72) Inventor: Ryo Shimamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/092,986

(22) Filed: Nov. 9, 2020

(65) Prior Publication Data

US 2021/0053360 A1 Feb. 25, 2021

Related U.S. Application Data

(63) Continuation of application No. 16/380,889, filed on Apr. 10, 2019, now Pat. No. 10,870,286.

(30) Foreign Application Priority Data

Apr. 23, 2018 (JP) ..... JP2018-082667

(51) Int. Cl.
*B41J 2/17* (2006.01)
*B41J 2/175* (2006.01)

(52) U.S. Cl.
CPC .. *B41J 2/17566* (2013.01); *B41J 2002/17576* (2013.01)

(58) Field of Classification Search
None
See application file for complete search history.

(56) References Cited

U.S. PATENT DOCUMENTS

2009/0179925 A1* 7/2009 Sugahara ..... B41J 2/17566 347/7
2010/0245501 A1 9/2010 Kanbe
2014/0034140 A1 2/2014 Kenichi

FOREIGN PATENT DOCUMENTS

| | | | |
|---|---|---|---|
| CN | 1799846 | A | 7/2006 |
| CN | 102909959 | A | 2/2013 |
| CN | 203110525 | U | 8/2013 |
| CN | 107735260 | A | 2/2018 |
| CN | 207028522 | U | 2/2018 |
| DE | 202017101415 | U1 | 6/2017 |
| JP | 2018052005 | A | 4/2018 |

* cited by examiner

*Primary Examiner* — Erica S Lin
(74) *Attorney, Agent, or Firm* — Canon U.S.A., Inc., IP Division

(57) ABSTRACT

An ink cartridge includes an ink chamber that stores ink. A protruding chamber protrudes upward from the ink chamber in a gravitational direction when the ink cartridge is used. A swing body has a float and a detection portion, and a detection chamber in which the detection portion moves and with which an amount of ink stored in the ink chamber is detected in accordance with a position of the detection portion. In the ink cartridge, a pivot center of the swing body that pivotally moves is disposed inside the protruding chamber.

20 Claims, 6 Drawing Sheets

INK CARTRIDGE HAVING A SWING BODY ADAPTED TO PIVOTALLY MOVE SMOOTHLY EVEN IF INK IS CONSUMED

CROSS REFERENCE TO RELATED APPLICATIONS

This application is a continuation of U.S. patent application Ser. No. 16/380,889, filed on Apr. 10, 2019, which claims priority from Japanese Patent Application No. 2018-082667, filed Apr. 23, 2018, all of which are hereby incorporated by reference herein in their entirety.

BACKGROUND OF THE DISCLOSURE

Field of the Invention

The disclosure relates to an ink cartridge.

Description of the Related Art

A known ink jet recording apparatus ejects ink from nozzles disposed on a recording head onto a recording medium and thereby records an image thereon. A type of such an ink jet recording apparatus includes an attachable/detachable ink cartridge. The ink cartridge stores ink in an ink chamber disposed in the ink cartridge. When the ink cartridge is installed in the ink jet recording apparatus, an ink outlet port of the ink cartridge and an ink supply port of the recording apparatus are connected to each other, and ink stored in the ink chamber can be thereby supplied to the recording head.

When the amount of ink remaining in the ink cartridge decreases and recording thereby becomes difficult, the ink cartridge is replaced with a new one, and recording can be resumed. To detect the amount of ink remaining in the ink cartridge, a detection method using an optical detector is proposed as described in Japanese Patent Laid-Open No. 2017-114017. The ink cartridge according to Japanese Patent Laid-Open No. 2017-114017 includes an ink chamber that stores ink, a detection window that is a light transmissive portion in which a detection space that continues to the ink chamber is formed, and a swing body to be used for detecting an ink remaining amount. The swing body includes a shaft hole that is fitted onto a supporting shaft disposed in the ink chamber, a float that pivotally moves toward both sides with the shaft hole interposed therebetween in the ink chamber, and a detection portion that pivotally moves in the detection window. The swing body moves pivotally about the supporting shaft. The detection window is disposed between a light emitter and a light receiver of an optical sensor included in the main body of the ink jet recording apparatus. Within the detection window, the detection portion is at a position where light from the light emitter is blocked in a case in which the ink remaining amount is large, and the detection portion moves to a position where light from the light emitter is not blocked in a case in which the ink remaining amount is small. The ink remaining amount in the ink chamber is detected on the basis of the amount of light received by the light receiver in these cases.

The swing body used in the ink cartridge according to Japanese Patent Laid-Open No. 2017-114017 pivotally moves in response to a change in the liquid level in the ink chamber and is expected to move smoothly. Accordingly, in the ink cartridge according to Japanese Patent Laid-Open No. 2017-114017, the shaft hole of the swing body is loosely fitted onto the supporting shaft.

In the ink cartridge according to Japanese Patent Laid-Open No. 2017-114017, the pivot center (i.e., the position where the supporting shaft and the shaft hole are located) of the swing body is disposed inside the ink chamber. Accordingly, the pivot center of the swing body is located in ink in an initial state of use (from a state before the ink cartridge is used to a state in which no less than a half of ink remains in the ink chamber). In this ink cartridge, the liquid level drops as ink is consumed, and a region between the supporting shaft and the shaft hole, which serve as the pivot center, are exposed to the interface between air and ink. In this case, according to the study of the inventors, the swing body ceases to move smoothly due to the ink present in the region between the supporting shaft and the shaft hole and due to surface tension of ink acting on members of the swing body. This leads to a problem that the ink remaining amount cannot be detected appropriately.

SUMMARY OF THE DISCLOSURE

The disclosure provides an ink cartridge that includes an ink chamber that stores ink, a protruding chamber that protrudes upward from the ink chamber in a gravitational direction when the ink cartridge is used, a swing body that has a float and a detection portion, and a detection chamber in which the detection portion moves and with which an amount of ink stored in the ink chamber is detected in accordance with a position of the detection portion. In the ink cartridge, a pivot center of the swing body that pivotally moves is disposed inside the protruding chamber.

Further features and aspects of the disclosure will become apparent from the following description of exemplary embodiments with reference to the attached drawings.

DESCRIPTION OF THE EMBODIMENTS

The disclosure provides an ink cartridge having a swing body that can pivotally move smoothly even if ink is consumed.

Numerous embodiments, features and aspects of the disclosure will now herein be described with reference to the drawings.

Figure 1A:
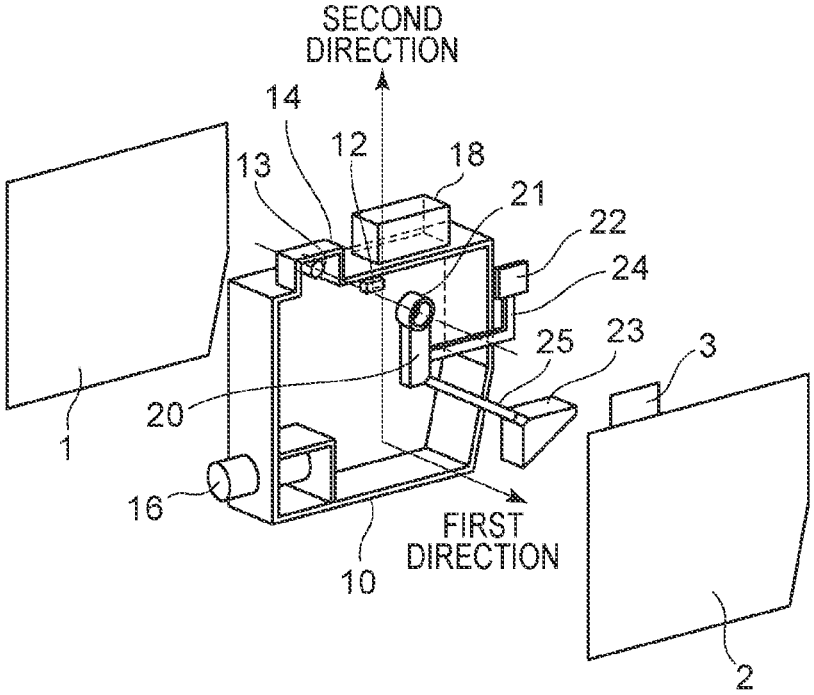
FIG. 1A and FIG. 1B are views illustrating an example ink cartridge.

FIG. 1A is an exploded perspective view of an ink cartridge according to the invention. The ink cartridge includes a main body frame 10, a first lid 1, and a second lid 2. A space surrounded by these elements is an ink chamber. The ink chamber can store ink. The first lid 1 and the second lid 2 are formed, for exemplary, of a pair of film sheets. For exemplary, transparent resin film may be used for the film sheets. The ink chamber is formed by adhering these film sheets by using thermal welding to the main body frame 10 that is made of resin. In FIG. 1A, the main body frame 10 is shaped like a frame that has openings opening in the first direction. The ink chamber is formed by joining the first lid 1 and the second lid 2 to the main body frame 10. However, the ink chamber is not limited to this form, but may be configured in any form as far as ink can be stored. For exemplary, the main body frame 10 may be formed integrally with the first lid 1 so as to have a shape like a vessel having a bottom and an opening that opens in the first direction, and the second lid 2 may be adhered to the main body frame 10 so as to cover the opening. Alternatively, the main body frame 10 may be formed integrally with the first lid 1 and the second lid 2.

The ink cartridge has an ink outlet port 16 at a lower portion of the ink cartridge in the gravitational direction when the ink cartridge is used. In FIG. 1A, the ink outlet port 16 opens from the main body frame 10. Here, the gravitational direction when the ink cartridge is used (hereinafter referred to simply as the "gravitational direction") is a direction parallel to the second direction in FIG. 1A. "When the ink cartridge is used" refers to a case where the ink cartridge is installed in an ink jet recording apparatus. In FIG. 1A, the arrow that represents the second direction points upward in the gravitational direction. From a viewpoint of making full use of ink, the ink outlet port is preferably disposed at a position below the center of the ink cartridge in the gravitational direction.

A protruding chamber 14 and a detection chamber 18 are disposed in the ink cartridge so as to protrude upward from the ink chamber in the gravitational direction. In FIG. 1A, two openings are provided in an upper portion of the main body frame 10 in the gravitational direction, and the protruding chamber 14 and the detection chamber 18 are in communication with the ink chamber through the two openings, respectively. The protruding chamber 14 protrudes upward in the gravitational direction, whereas the detection chamber 18 need not protrude upward, which will be described later. For exemplary, the detection chamber 18 may protrude in a direction intersecting the gravitational direction (i.e., in the first direction or in a direction intersecting the gravitational direction and the first direction). The protruding chamber 14 and the detection chamber 18 may be formed integrally with the main body frame 10. In FIG. 1A, the protruding chamber 14 is formed integrally with the main body frame 10. The detection chamber 18 is a chamber for detecting the amount of ink stored in the ink chamber, which will be described later in detail.

A swing body 20 is disposed inside the ink chamber. The swing body 20 is a member that can pivotally moves in response to a change in the amount of liquid inside the ink chamber. The swing body 20 includes a detection portion 22 and a float portion 23. The detection portion 22 and the float portion 23 are connected to each other by a first arm 24 and a second arm 25. A shaft hole 21 that forms a pivot center is disposed in the swing body 20 at a position between the first arm 24 and the second arm 25. The shaft hole 21 is loosely fitted onto a supporting shaft 13 that is shaped like a protrusion protruding in the first direction. The end of the supporting shaft 13 is covered by a member, such as a covering member 3 or the second lid 2, thereby preventing the shaft hole 21 from coming off the supporting shaft 13. Alternatively, the end of the supporting shaft 13 may be deformed by heat so as to prevent the shaft hole 21 from coming off. The swing body 20 moves pivotally about a pivot center that is constituted by the shaft hole 21 and the supporting shaft 13. The pivot center of the swing body 20 is not limited to this form but may be configured in any form as far as the pivot center serves as the center of pivotal movement when the swing body 20 pivotally moves.

Figure 1B:
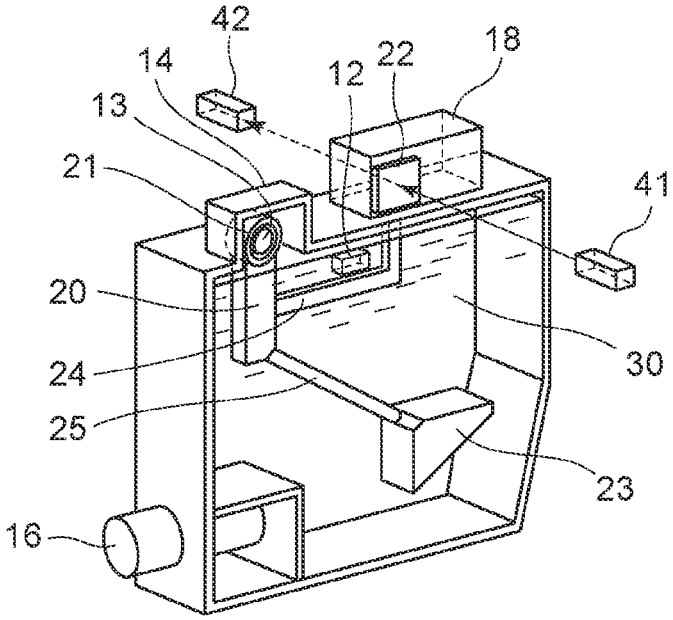

FIG. 1B illustrates the ink cartridge in the case where the ink chamber is filled with ink and installed in the ink jet recording apparatus (i.e., when the ink cartridge is used). The shaft hole 21 of the swing body 20 is loosely fitted onto the supporting shaft 13 that is disposed inside the protruding chamber 14. Buoyancy acing on the float portion 23 causes the swing body 20 to pivotally move about the shaft hole 21 as the pivot center. The pivotal movement causes the detection portion 22 of the swing body 20 to move within the detection chamber 18. The detection portion 22 may move from the detection chamber 18 into the ink chamber. Note that a protrusion 12 is disposed inside the ink chamber, and pivotal movement of the swing body (in other words, movement of the float portion 23 moving upward in the gravitational direction) may be regulated due to the first arm 24 coming into contact with the protrusion 12. In the state illustrated in FIG. 1B, the detection portion 22 is positioned so as to block light emitted from a light emitter 41 included in the ink jet recording apparatus, thereby preventing the light from reaching a light receiver 42 that is also included in the ink jet recording apparatus. On the basis of the light not reaching the light receiver 42 or the amount of light being less than a predetermined amount, it can be detected that a sufficient amount of ink remains in the ink chamber.

Figure 2A:
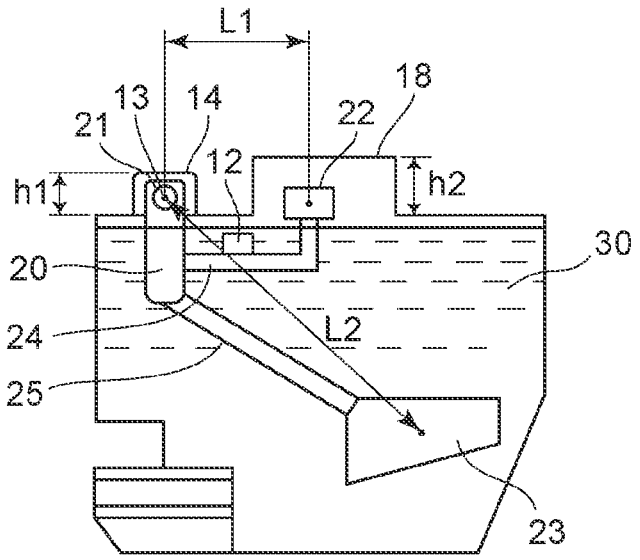
FIG. 2A and FIG. 2B are views illustrating a state in which an example swing body pivotally moves inside the ink cartridge.
Figure 2B:
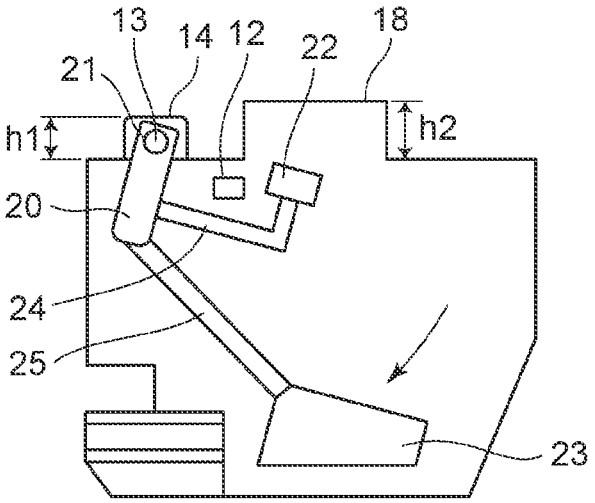

In a state where the ink chamber does not contain ink, the swing body 20 rotates due to the balance between the total weight of the second arm 25 and the float portion 23 and the total weight of the first arm 24 and the detection portion 22. FIG. 2A illustrates the ink cartridge that contains ink fully in the ink chamber, which is the same state as in FIG. 1B. FIG. 2B illustrates the ink cartridge that has no ink in the ink chamber after ink is consumed from the state in FIG. 2A.

As illustrated in FIG. 2A, the swing body 20 is loosely fitted onto the supporting shaft 13 inside the protruding chamber 14 so as to be able to move pivotally (rotate) about the pivot center where the shaft hole 21 is disposed. The shortest distance L1 between the pivot center and the center of gravity of the detection portion 22 is preferably smaller than the shortest distance L2 between the pivot center and the center of gravity of the float portion 23. In addition, the total volume of the first arm 24 and the detection portion 22 is preferably smaller than the total volume of the second arm 25 and the float portion 23. In a state where the ink chamber fully contains ink 30, buoyancy acts upward on the float portion 23 in the gravitational direction, which causes the swing body 20 to rotate counterclockwise about the center of the shaft hole 21. The first arm 24 consequently comes into contact with the protrusion 12 and is prevented from further movement, as described above, and the detection portion 22 comes to rest inside the detection chamber 18.

As ink contained in the ink chamber is consumed from the state in FIG. 2A, the float portion 23 is exposed from the ink as illustrated in FIG. 2B and buoyancy ceases to act. As this occurs, the swing body 20 rotates (pivotally moves) clockwise about the center of the shaft hole 21 as indicated by the arrow in FIG. 2B. This rotation causes the detection portion 22 to move within the detection chamber 18. The detection portion 22 may move eventually out of the detection chamber 18 into the ink chamber. The detection portion 22 that has moved away does not block light from the light emitter 41 illustrated in FIG. 1B. As a result, the light receiver 42 receives light, and on the basis of this result, it can be detected that the amount of ink remaining in the ink chamber becomes small.

In the ink cartridge according to the invention, the pivot center of the swing body 20 (i.e., the portion in which the shaft hole 21 and the supporting shaft 13 are positioned in FIGS. 1A, 1B, 2A, and 2B) that pivotally moves is disposed inside the protruding chamber 14 that protrudes upward from the ink chamber in the gravitational direction. The protruding chamber 14 protruding upward from the ink chamber in the gravitational direction does not contain ink even in the initial state in which the ink chamber is filled with ink. Accordingly, the pivot center inside the protruding chamber 14 is hardly in contact with ink, thereby suppressing the likelihood of ink entering the space between the shaft hole 21 and the supporting shaft 13. Thus, the swing body 20 can pivotally move smoothly in response to the amount of ink remaining inside the ink chamber.

The protruding chamber 14 may be formed such that the protruding chamber 14 and the ink chamber are partitioned from each other except for a space through which the swing body 20 moves and thereby ink does not enter the protruding chamber 14 easily. However, from a viewpoint of smooth movement of the swing body 20, the ink chamber and the protruding chamber 14 are preferably in communication with each other through an opening having a size that enables ink to flow. The opening is provided in a member that forms the ink chamber (for exemplary, the main body frame). In consideration of these points, it is preferable that in the first direction that intersects the gravitational direction, the width of the opening between the protruding chamber 14 and the ink chamber be equal to or smaller than four-fifths of the width of the ink chamber. Moreover, it is preferable that in the first direction, the width of the opening between the protruding chamber 14 and the ink chamber be equal to or larger than one-fifth of the width of the ink chamber.

In order to avoid increasing the overall size of the ink cartridge, it is preferable that the height h1 of the protruding chamber 14 in the gravitational direction be similar to or smaller than the height h2 of the detection chamber 18 in the gravitational direction. More specifically, the relation between the height h1 of the protruding chamber 14 and the height h2 of the detection chamber 18 preferably satisfies $0.3 \leq h1/h2 \leq 1.1$, or more preferably $0.5 \leq h1/h2 \leq 1.0$, or even more preferably $0.6 \leq h1/h2 \leq 0.9$.

Figure 3:
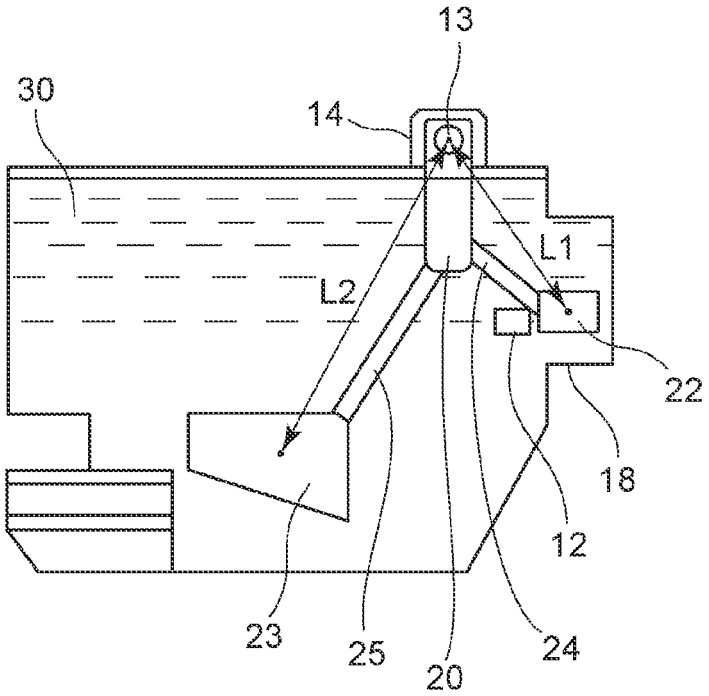
FIG. 3 is a view illustrating another example ink cartridge.

FIG. 3 illustrates an exemplary in which a detection chamber protrudes in a direction intersecting the gravitational direction. In FIG. 3, the detection chamber 18 protrudes in a direction intersecting the gravitational direction. Note that the protruding chamber 14 still protrudes upward from the ink chamber in the gravitational direction. The shaft hole 21, which is the pivot center of the swing body 20, is disposed inside the protruding chamber 14. With this configuration, in the initial state in which the ink chamber is filled with ink, the pivot center is not in contact with ink, whereas the detection portion 22 is in contact with ink. In the configuration in FIG. 3, the shortest distance L1 between the pivot center and the center of gravity of the detection portion 22 is preferably smaller than the shortest distance L2 between the pivot center and the center of gravity of the float portion 23. In addition, the volume of the first arm 24 is preferably smaller than the volume of the second arm 25. Moreover, the total volume of the first arm 24 and the detection portion 22 is preferably smaller than the total volume of the second arm 25 and the float portion 23. The protrusion 12 is also disposed inside the ink chamber in the ink cartridge in FIG. 3. The protrusion 12 comes into contact with the first arm 24 and prevents the swing body from moving further clockwise.

Figure 4A:
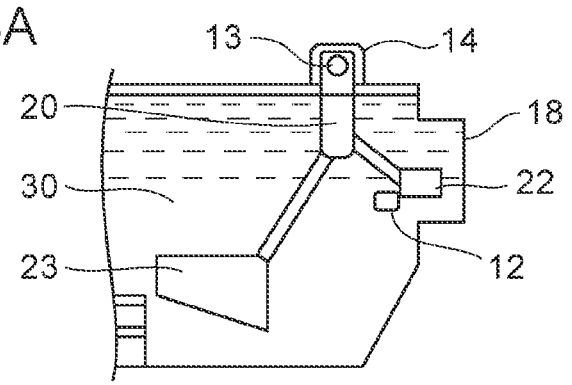
FIG. 4A, FIG. 4B, FIG. 4C, and FIG. 4D are views illustrating a state in which another example swing body pivotally moves inside the ink cartridge.
Figure 4B:
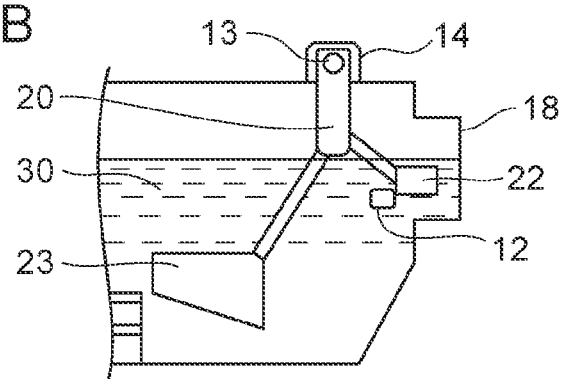
Figure 4C:
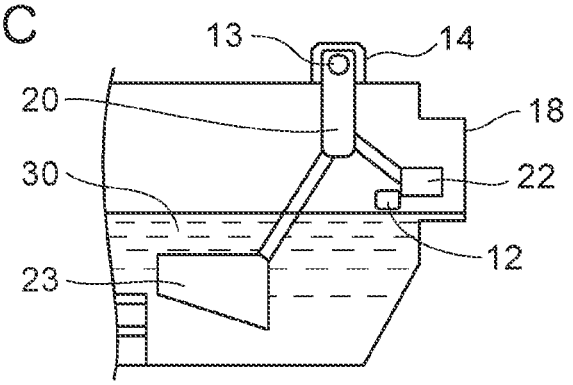
Figure 4D:
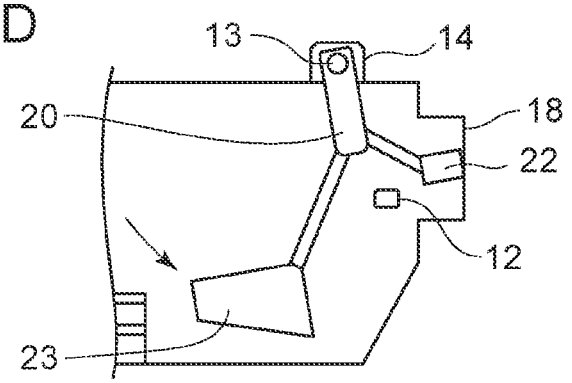

FIGS. 4A to 4D illustrates movement of the swing body 20 as the ink stored in the ink cartridge in FIG. 3 is consumed. In FIG. 4A, the swing body 20 is at rest with the detection portion 22 and the float portion 23 staying in ink 30. In FIG. 4B, the amount of ink decreases, and the level of ink comes in the detection chamber 18. In FIG. 4C, the level of ink is below the detection portion 22 in the gravitational direction, and the detection portion 22 is exposed. At this time, the float portion 23 still stays in the ink 30, and buoyancy acts upward on the float portion 23 in the gravitational direction. This enables the swing body 20 to remain at rest. When ink is consumed further, the float portion 23 is exposed from the ink 30 as illustrated in FIG. 4D. In this state, gravity acts directly on the float portion 23 and causes the swing body 20 to rotate counterclockwise about the supporting shaft 13 as indicated by the arrow in FIG. 4D. The movement of the swing body 20 described above is controlled by the balance between buoyancy and gravity acting on the float portion 23 and changes as the level of ink changes.

Figure 5:
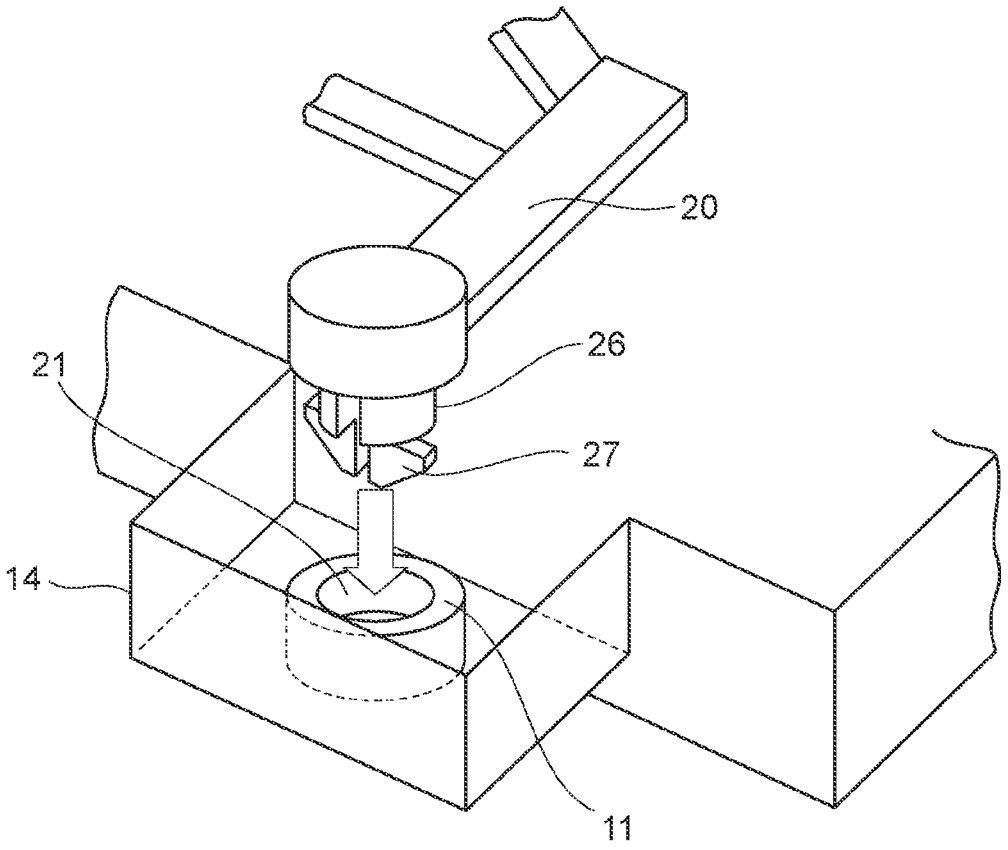
FIG. 5 is a view illustrating a state before a pivot center of the swing body is formed.

FIG. 5 illustrates a configuration exemplary of the pivot center of a swing body. FIG. 5 is a view illustrating a state before the pivot center of the swing body 20 is formed. In this exemplary, the swing body 20 includes a supporting shaft 26, and a supporting shaft end portion 27 of the supporting shaft 26 is loosely fitted into the shaft hole 21 of a swing body supporting portion 11 in the protruding chamber 14.

Figure 6A:
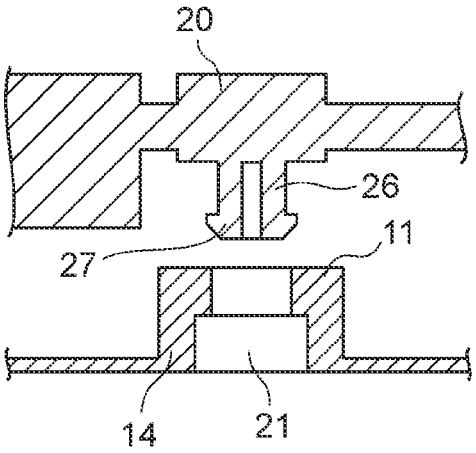
FIG. 6A, FIG. 6B, FIG. 6C, and FIG. 6D are views illustrating a state in which the pivot center of the swing body and an ink chamber are formed.
Figure 6B:
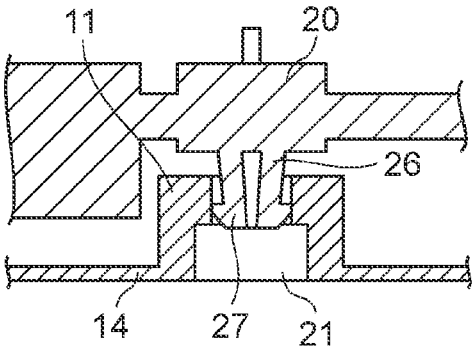
Figure 6C:
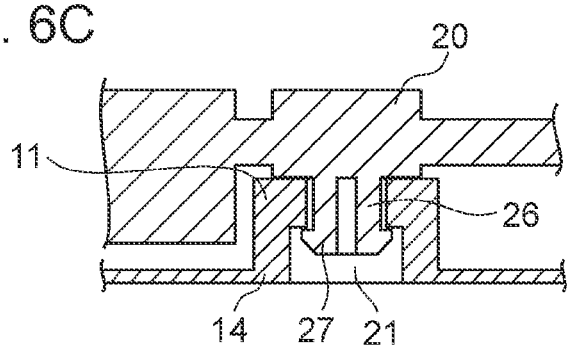

More specifically, as illustrated in FIG. 6A, the supporting shaft 26 of the swing body 20 is oriented toward the shaft hole 21 formed in the swing body supporting portion 11 of the protruding chamber 14. In this state, the axis of the supporting shaft 26 of the swing body 20 is disposed so as to align with the axis of the shaft hole 21. The pivotal shaft of the swing body 20 is formed of the supporting shaft 26 that has a columnar shape with a notch at the center thereof and of the supporting shaft end portion 27 that has a width larger than the outside diameter of the supporting shaft 26.

Next, the swing body 20 is lowered along the axis of the hole and loosely fitted into the shaft hole 21. The supporting shaft end portion 27 has a tapered shape in which the width becomes smaller toward the end, and accordingly the supporting shaft 26 is guided easily into the shaft hole 21. The supporting shaft 26 has the notch at the center, and the width of the supporting shaft end portion 27 is larger than the width of the supporting shaft 26. Accordingly, the supporting shaft end portion 27 deforms elastically and gradually fitted into the shaft hole 21 without suffering from a breakage, or the like, of a side portion of the supporting shaft 26 when coming into contact with the surface of the shaft hole 21. In this step, the swing body 20 is rotated so as to cause the detection portion 22 of the swing body 20 to come inside the detection chamber of the ink cartridge. The maximum width of the supporting shaft end portion 27 is larger than the diameter of the shaft hole 21, which prevents the swing body 20 from coming off. A small gap is formed between the supporting shaft 26 and the shaft hole 21, and the swing body 20 can thereby pivotally move (rotate) rightward or leftward about the axis of the shaft hole 21. Thus, the pivot center of the swing body 20 is formed inside the protruding chamber.

Figure 6D:
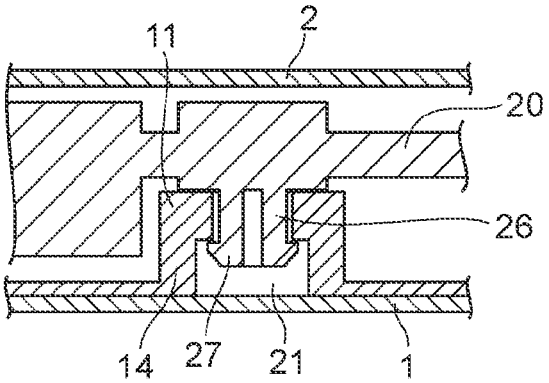

Subsequently, as illustrated in FIG. 6D, the first lid 1 and the second lid 2 are adhered to the main body frame so as to interpose the swing body 20 therebetween and cover the face of the main body frame having the protruding chamber 14 and the opening as well as the opposite face. These lids are adhered by using, for exemplary, a thermal welding (thermocompression bonding). In this case, the swing body 20 is preferably made of a resin having a higher melting point than the resin used for the main body frame and for the first lid 1 and second lid 2 in order to reduce thermal deformation of the swing body 20. Thus, a pair of walls that cover upper and lower openings are formed with the swing body 20 interposed therebetween, and consequently the ink chamber that stores ink is formed. With the configuration in which the swing body 20 is loosely fitted onto the supporting shaft 26 and the width of the supporting shaft end portion 27 is larger than the inside diameter of the shaft hole 21, the likelihood of the swing body 20 coming off can be reduced without using a covering member or the like.

While the disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink cartridge comprising:

an ink chamber configured to store ink;

a swing body having a float and a detection portion;

a detection chamber in which the detection portion is configured to move, wherein the detection chamber is configured to detect an amount of ink stored in the ink chamber in accordance with a position of the detection portion; and a protruding chamber that protrudes upward from the ink chamber in a gravitational direction when the ink cartridge is used, wherein a pivot center of the swing body is always above a liquid level of ink in a gravitational direction when the ink cartridge is used, and wherein the pivot center of the swing body configured to pivotally move is disposed inside the protruding chamber.

2. The ink cartridge according to claim 1, wherein the detection chamber protrudes from the ink chamber in a direction intersecting the gravitational direction.

3. The ink cartridge according to claim 1, wherein the protruding chamber is in communication with the ink chamber through an opening provided in a member that forms the ink chamber, and wherein in a direction intersecting the gravitational direction, a width of the member opening is equal to or larger than one-fifth of a width of the ink chamber.

4. The ink cartridge according to claim 1, wherein the detection chamber protrudes upward from the ink chamber in the gravitational direction.

5. The ink cartridge according to claim 1, further comprising a protruding chamber, wherein a width h1 of the protruding chamber in the gravitational direction and a width h2 of the detection chamber in the gravitational direction satisfy $0.3 \leq h1/h2 \leq 1.1$.

6. The ink cartridge according to claim 1, further comprising a protruding chamber, wherein a width h1 of the protruding chamber in the gravitational direction and a width h2 of the detection chamber in the gravitational direction satisfy $0.5 \leq h1/h2 \leq 1.0$.

7. The ink cartridge according to claim 1, further comprising a protruding chamber, wherein a width h1 of the protruding chamber in the gravitational direction and a width h2 of the detection chamber in the gravitational direction satisfy $0.6 \leq h1/h2 \leq 0.9$.

8. An ink cartridge comprising:

an ink chamber configured to store ink;

a swing body having a float and a detection portion;

a detection chamber in which the detection portion is configured to move, wherein the detection chamber is configured to detect an amount of ink stored in the ink chamber in accordance with a position of the detection portion; and a protruding chamber that protrudes upward from the ink chamber in a gravitational direction when the ink cartridge is used, wherein a pivot center of the swing body is always above a liquid level of ink in a gravitational direction when the ink cartridge is used, wherein the pivot center of the swing body configured to pivotally move is disposed inside the protruding chamber, and wherein the protruding chamber is in communication with the ink chamber through an opening provided in a member that forms the ink chamber.

9. The ink cartridge according to claim 8, wherein the detection chamber protrudes from the ink chamber in a direction intersecting the gravitational direction.

10. The ink cartridge according to claim 8, wherein in a direction intersecting the gravitational direction, a width of the member opening is equal to or larger than one-fifth of a width of the ink chamber.

11. The ink cartridge according to claim 8, wherein the detection chamber protrudes upward from the ink chamber in the gravitational direction.

12. The ink cartridge according to claim 8, further comprising a protruding chamber, wherein a width h1 of the protruding chamber in the gravitational direction and a width h2 of the detection chamber in the gravitational direction satisfy $0.3 \leq h1/h2 \leq 1.1$.

13. The ink cartridge according to claim 8, further comprising a protruding chamber, wherein a width h1 of the protruding chamber in the gravitational direction and a width h2 of the detection chamber in the gravitational direction satisfy $0.5 \leq h1/h2 \leq 1.0$.

14. The ink cartridge according to claim 8, further comprising a protruding chamber, wherein a width h1 of the protruding chamber in the gravitational direction and a width h2 of the detection chamber in the gravitational direction satisfy $0.6 \leq h1/h2 \leq 0.9$.

15. An ink cartridge comprising:

an ink chamber configured to store ink;

a swing body having a float and a detection portion;

a detection chamber in which the detection portion is configured to move, wherein the detection chamber is configured to detect an amount of ink stored in the ink chamber in accordance with a position of the detection portion; and a protruding chamber that protrudes upward from the ink chamber in a gravitational direction when the ink cartridge is used, wherein a pivot center of the swing body is always above a liquid level of ink in a gravitational direction when the ink cartridge is used, wherein the pivot center of the swing body configured to pivotally move is disposed inside the protruding chamber, wherein the protruding chamber is in communication with the ink chamber through an opening provided in a member that forms the ink chamber, and wherein, in a direction intersecting the gravitational direction, a width of the member opening is equal to or smaller than four-fifths of a width of the ink chamber.

16. The ink cartridge according to claim 15, wherein the detection chamber protrudes from the ink chamber in a direction intersecting the gravitational direction.

17. The ink cartridge according to claim 15, wherein the detection chamber protrudes upward from the ink chamber in the gravitational direction.

18. The ink cartridge according to claim 15, further comprising a protruding chamber, wherein a width h1 of the protruding chamber in the gravitational direction and a width h2 of the detection chamber in the gravitational direction satisfy $0.3 \leq h1/h2 \leq 1.1$.

19. The ink cartridge according to claim 15, further comprising a protruding chamber, wherein a width h1 of the protruding chamber in the gravitational direction and a width h2 of the detection chamber in the gravitational direction satisfy $0.5 \leq h1/h2 \leq 1.0$.

20. The ink cartridge according to claim 15, further comprising a protruding chamber, wherein a width h1 of the protruding chamber in the gravitational direction and a width h2 of the detection chamber in the gravitational direction satisfy $0.6 \leq h1/h2 \leq 0.9$.

* * * * *